United States Patent [19]

Leloux

[11] 3,960,062

[45] June 1, 1976

[54] METHOD OF MAKING A BAND OF PLASTIC BAGS

[75] Inventor: Arnoldus Willem Jan Leloux, Dedemsvaart, Netherlands

[73] Assignee: Wavin B.V., Zwolle, Netherlands

[22] Filed: Sept. 30, 1974

[21] Appl. No.: 510,684

[30] Foreign Application Priority Data

Sept. 29, 1973 Netherlands ..... 7313440

[52] U.S. Cl. ..... 93/35 R; 83/30; 93/33 R; 93/58 P; 206/390

[51] Int. Cl.[2] ..... B31B 49/04

[58] Field of Search ..... 206/390; 93/35 R, 58 P, 93/1 TS, 33 R; 83/660, 30, 52

[56] References Cited

UNITED STATES PATENTS

| | | | |
|---|---|---|---|
| 2,773,285 | 12/1956 | Piazze et al. | 206/390 X |
| 3,481,461 | 12/1969 | Paxton | 206/390 |

FOREIGN PATENTS OR APPLICATIONS

| | | | |
|---|---|---|---|
| 643,350 | 9/1950 | United Kingdom | 206/390 |
| 426,244 | 3/1935 | United Kingdom | 206/390 |

*Primary Examiner*—Stephen P. Garbe
*Attorney, Agent, or Firm*—Alan H. Levine

[57] ABSTRACT

A band of bags of plastic material connected with each other by perforation lines. In the two end parts of each perforation line the number of perforations and/or the width of the perforations per unit of width is greater than in the central part of the perforation line. A device for manufacturing said band of bags comprises a perforating member with equidistantly spaced first perforating pins and second perforating pins are present on either side of a central area between the first perforating pins.

5 Claims, 3 Drawing Figures

METHOD OF MAKING A BAND OF PLASTIC BAGS

BACKGROUND OF THE INVENTION

My invention relates to a band of synthetic plastic bags comprising a plurality of interconnected synthetic bags; provided in this band between two consecutive bags is a line of weakness, particularly consisting of perforations, which extends for the width of the band.

A continuous band of synthetic bags of the aforementioned type is known comprising a plurality of interconnected bags formed by transverse sealed joints in a synthetic tubular foil, there being in the vicinity of each bottom of a bag a perforation for tearing off a bag from the band. In order to reduce to a minimum the force required for tearing off a bag, it would be advisable to make the number of perforations as great as possible. For severing a part, e.g., comprising ten bags from a continuously supplied band of synthetic bags it is required that the line of weakness be such that such a part can be torn off in the simplest possible way.

On the other hand, however, the band of synthetic bags should be of sufficient strength on being conveyed after the perforating action has been effected, that in the course of subsequent treatments, like heatsealing, printing, conveying, folding and winding, it remains in one piece.

Moreover, it should be provided for that, on perforating, the perforating force is simultaneously applied across the entire width of the flat lying band and is also regularly distributed across the full width. If this is not the case, then the perforating step gives rise to the formation of creases in the flat lying band of bags or causes the band of plastic bags to slip from its track so that the subsequent operations cannot be performed.

SUMMARY OF THE INVENTION

The invention aims to provide a band of synthetic bags of the aforementioned type, wherein by means of a simple pull a bag can be torn off from the band, but on the other hand the band of synthetic bags as a whole is the sufficient strength to permit of same being conveyed while a pull is exerted thereon.

This can be attained according to the invention by providing in the band of synthetic bags, in the flat lying conditon thereof, on either side of a first central line of perforations a second line of perforations in which the number and/or width of the perforations per unit of width is greater than in the first, central, line.

Due to the fact that the aforementioned second lines of perforations lie on the sides of the finished plastic bags, it becomes possible to tear off a bag in an easier way from the sides, while on the other hand the central part with fewer perforations can still be severed from the band without difficulty, since there are adequate points of application enabling a pull to be exerted on the bag to be severed.

With particular advantage the first line of perforations is situated about in the central part of a flat lyihg band and it covers less than 50% of the full width of the band.

Preferably the first line extends for a length ranging from 5 to 10% of the full width of the flat lying band of bags.

The invention also comprises a method for the formation of a band of plastic bags, comprising a plurality of bags with various lines of weakness provided across the width of the band, particularly perforations, while a flat-lying conveyed band, prior to or after forming the transverse sealed joints therein, is preforated across its full width, wherein on either side of a central line of perforations the number and/or width of the perforations per unit of width is greater than in the central line of perforations.

Across the entire width of the band of plastic bags are simultaneously or not and preferably simultaneously made substantially uniformly distributed first perforations and thereupon, beside the central area of perforations and between those first perforations, are made second perforations. This method offers the advantage that during the perforating no wrinkles form in the band of foil as is explained hereinafter.

A device according to the invention for making perforations in a band of plastic bags, consisting of a plurality of plastic bags with various perforations distributed across the width of the band, comprises at least one feed member for supplying a tubular foil, a member for forming a transverse joint in the tubular foil and perforating member with equidistantly spaced perforations-forming first parts, the perforations-forming second parts being situated in between the perforations-forming first parts situated in the proximity of the end edges of the perforating member.

The perforating member is provided with equidistantly spaced perforating pins, while on either side of the central section of this member second pins are provided between the first pins, the height of the second pins being smaller than the height of the first perforating pins in such a way that due to the difference these pins come into contact with a foil when the tips of the first perforating pins have pierced the foil.

As a consequence a more uniform distribution of forces is obtained on the full width of the foil band at the beginning of the perforating treatment, while some moments later when the uniform perforating force has decreased there is produced a second perforating force which is absent in the central part of the foil band. As a consequence the formation of wrinkles in the foil band is avoided, which do form when both the first and second perforating pins act simultaneously upon the foil band. Also during the advance of the foil band the band perforated in this waY tends to remove possibly formed wrinkles. The tensile strength of the foil band is greater in the central part than on the sides, whereby the sides hardly assist in transmitting the pull used for conveying the foil band. The outer side pulls slightly as soon as stress is exerted thereon. The fact that tensile stress is almost absent in the sides of the foil band substantially prevents the inward directed forces of the guide rollers from acting upon the foil band on the outer sides thereof.

Due to the features according to the invention the band of synthetic foil can easily be folded by means of a folding triangle, since the folding triangle is primarily effective on the stronger central part of the band of synthetic bags. Since the perforations weaken the foil band less in this area, the forces developed on folding can be properly absorbed without a rupture being created on the line of weakness. After folding the foil band is rolled up, whereupon the machine for each bundle of bags should break a line of weakness. This breaking of the perforations is possible with a limited force, since after folding two sides of the foil band lie on one side, so that on that side the foil band is weaker than on the other side. When th tensile stress is stepped up at the desired location in the foil band, then the foil starts cracking on the weak side and will subsequently be torn off along the entire perforation without increase of the pull.

DESCRIPTION OF THE PREFERRED EMBODIMENT

Figure 1:
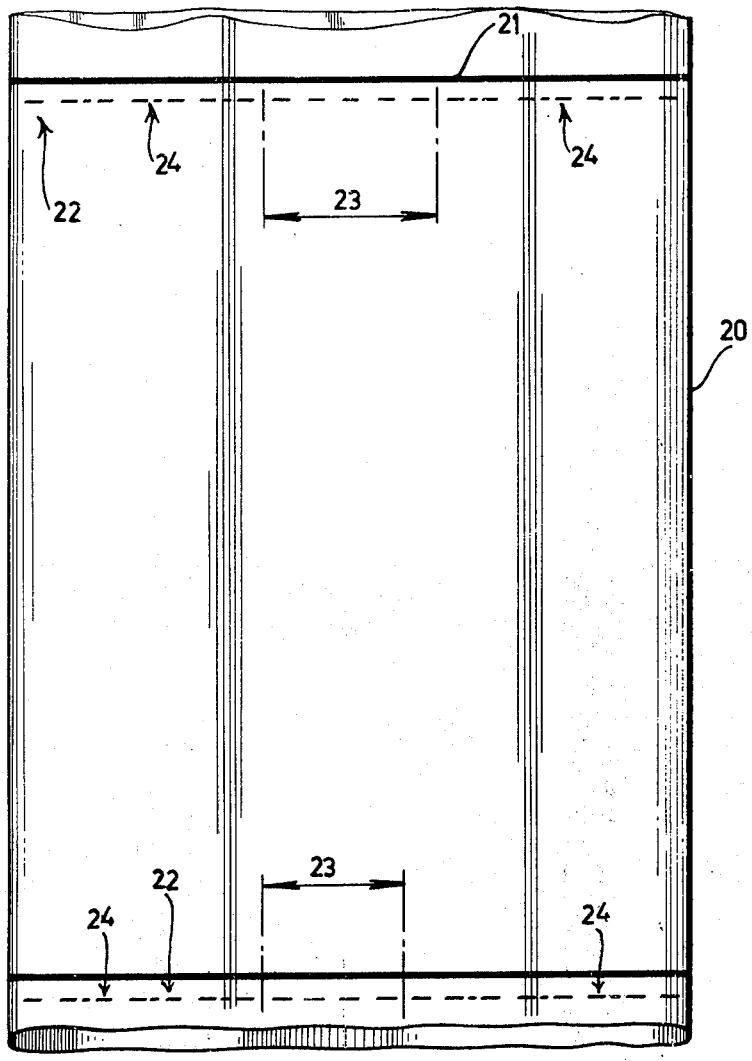
FIG. 1 shows a band of plastic bags according to the invention.

In FIG. 1 a band of plastic bags is shown which is obtained by forming transverse sealed joints 21 in a tubular foil 3 and by piercing a transverse perforation 22 in the foil. This transverse perforation comprises a central first area of perforations 23 and on either side thereof second perforation areas 24, the distance between the perforations of the area 24 being smaller than the distance between the perforations of the area 23.

Figure 3:
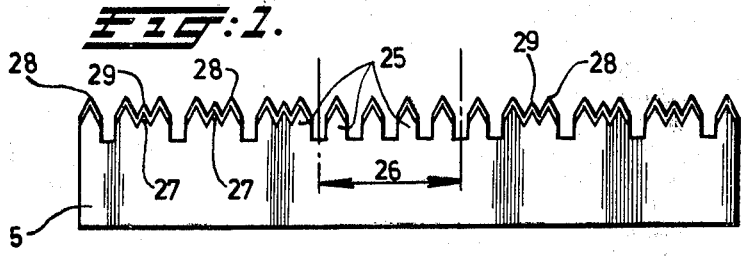
FIG. 3 shows a perforator as used in accordance with the method according to the invention.

The central perforation areas 23 and the two lateral perforation areas 24 can be obtained by a perforator 5 (FIG. 3) which on its entire width carries uniformly distributed first perforating pins 25, while outside the central area 26 a second pin 27 is situated between a pair of first pins 25.

The extreme ends 28 of the pins 25 are situated in one plane. The tips 29 of the intermediate second perforating pins 27 are situated in a plane which is slightly lower than the plane through the tips 28.

The tips 29 pierce the foil material only when the tips 28 have already pierced the foil layers.

By disposing the pins 25 across the full width of the synthetic foil it is ensured that the perforation extends uniformly across the entire width, while immediately thereupon by means of the pins 27 second perforations are provided in the lateral areas.

The process for obtaining a band of synthetic bags is described hereinafter.

Figure 2:
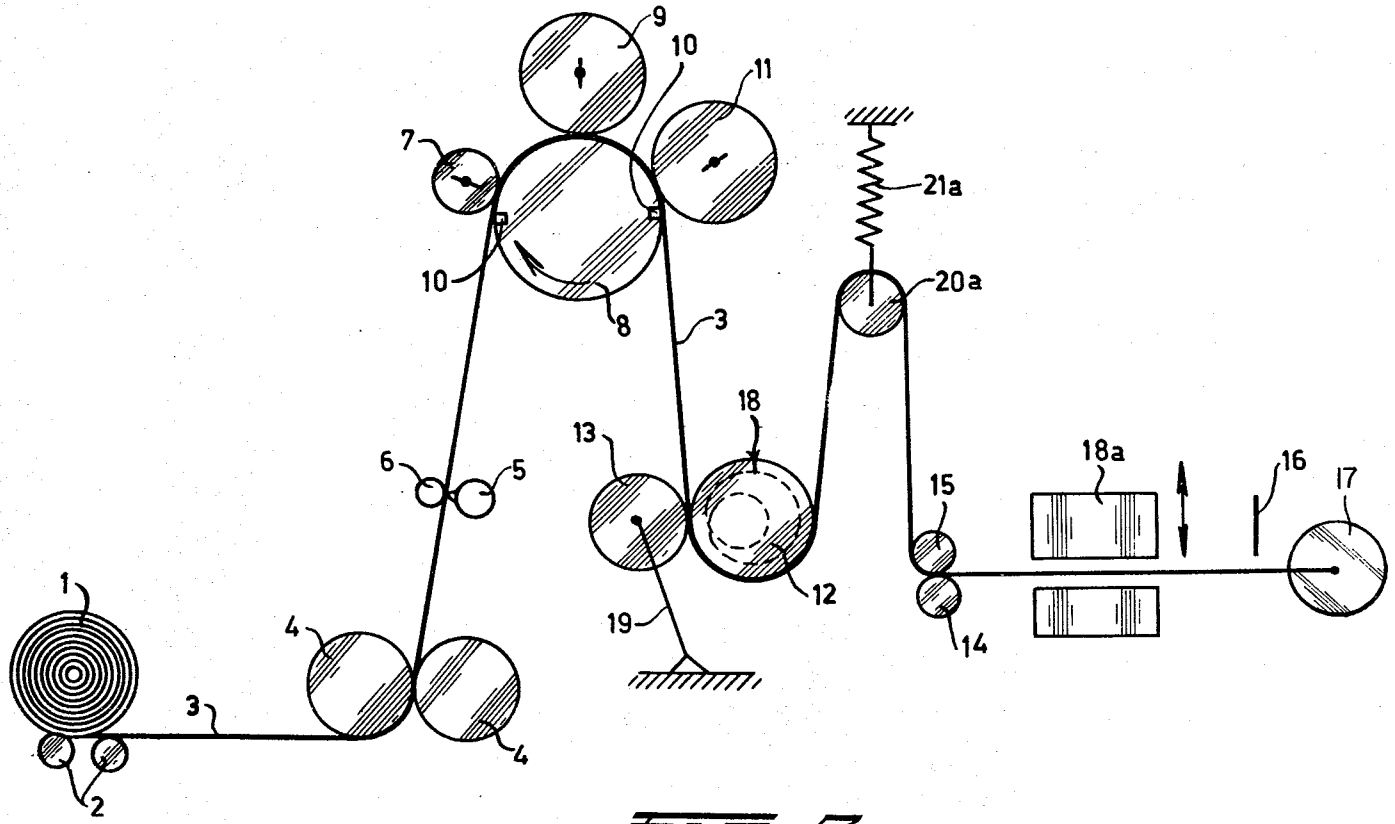
FIG. 2 shows a device for manufacturing such bands of plastic bags.

FIG. 2 shows in outline a device for manufacturing such bands of synthetic bags. This device is provided with a rotatably supported reel 1 on which is wound a tubular plastic foil 3. The reel bears on rotatable rubber rollers 2 which can be driven with a circumferential speed corresponding with the desired rate of feed of the foil band.

The speed of rotation of the driving motor can be regulated immediately after the foil band passes over the guide rollers 4.

A perforator 5 is arranged after the guide rollers 4, by which means a line of weakness is provided on the tubular foil 3, or holes forming a tansverse perforation 22 are punched therein. The individual bags can be separated along these transverse perforations 22. This perforator 5 consists of the knife already described hereinbefore which is on a roller cooperating with an opposite pusher roller.

After perforating, the band of tubular foil 3 is passed over a rotatable drum 8. This rotatable drum 8 is provided with a metal surface and carries two sealing rods 10. These sealing rods 10 are disposed in the drum in such a way that they are thermally insulated. The sealing rod 10 consists of a metal rod, e.g., a copper rod, covered with Teflon, while this sealing rod by means of heating members is brought up to a temperature ranging from 200° to 400° C depending on the thickness of the foil, the driving rate and the foil material. The foil band 3 is pressed against the sealing rod 10 by means of guide rollers 4 in such a way that no stress acts on the band. The surfaces of the foil are softened so that the foil layers are thereupon interconnected due to pressure. The surfaces of the roller 8 adjacent to the sealing rods 10 should, however, have a temperature which falls below the softening temperature of the plastic foil. After having reached this temperature the foil band is passed between a cooling roller 12 and the presser roller 13. It has been found that the quality of the sealed joint for compressing after previous softening is considerably improved. The cooling roller 12 is provided with an inner cooling spiral 18, whereby the temperature of the metal surface of the cooling roller is maintained at room temperature or lower.

In order to prevent the upper foil layer from sliding with respect to the lower layer during the action of the sealing rod 10, there are arranged contact rollers or brushes 7, 9 and 11. The smallest distance between the surface of the roller 8 and the rollers 7, 9 and 11 corresponds to the total thickness of the layers of the tubular foil, which are lying one on the other. The contact rollers 7, 9 and 11 have, however, no forcing effect. The sealing rods 10 may also be insulated in the surface of the roller 8 by means of an asbestos insulation.

The surface of the presser roller 13 consists preferably of rubber; however, other materials, e.g., metal or a metal surface covered with Teflon, may be selected. In particular cases the firstmentioned material is, however, preferred. A lever 19 is also arranged for pressing the roller 13 against the cooling roller 12.

The guide rollers 4 convey the tubular foil 3 slightly faster that the rollers 13 and the cooling roller 12, so that the tubular foil is stressless when it contacts the sealing rod 10.

After the tubular foil has left the sealing rod 10 the tubular foil is slippingly pulled from between the rollers 12, 13 by means of the tension roller 20*a* which cooperates with a spring 21*a*. In this way the formation of too great a curve between the roller 8 and the rollers 12, 13 is avoided. The same result is obtained when the roller 13 is spaced from the roller 12.

Two cooperating rollers 14 and 15, moving the tubular foil at the same rate as the feed roller 4, are arranged after the cooling roller 12 and the pusher roller 13.

Through the rollers 14, 15 the tubular foil is passed over a printing machine 18*a*, where the foil is printed. Finally the foil is folded by means of a folding triangle 16 and subsequently wound on a winding device 17, e.g., a band of plastic bags comprising a total of twenty bags. At that time the supplied band of bags is severed along the perforation of the wound up part.

What I claim is:

1. A method of making an interconnected band of plastic bags, comprising the steps of:

a. providing an elongated band of thermoplastic foil, the band having two superposed walls, b. sealing the walls of the band together along longitudinally spaced-apart transverse seal lines, c. piercing the band with longitudinally spaced-apart transverse lines of perforations, each line comprising a series of first perforations all of which are formed simultaneously, and d. thereafter piercing the band along each line of perforations to form second perforations between the first perforations, the second perforations being provided only in two side sections of each line between a central section of the line and the longitudinal side edges of the band, no second perforations being provided in the central section of each line.

2. A method as defined in claim 1 wherein the first perforations are uniformly distributed along the length of each line of perforations.

3. A method as defined in claim 1 wherein the first perforations are of equal length and are equidistantly spaced apart.

4. A method as defined in claim 1 wherein the length of the central section of each line of perforations is less than 50% of the total length of the line of perforations.

5. A method as defined in claim 1 wherein the length of the central section of each line of perforations is between 5 and 10% of the total length of the line of perforations.

* * * * *